United States Patent [19]

Kaufman

[11] 4,024,739

[45] May 24, 1977

[54] SLIDING GLASS DOOR LOCK

[76] Inventor: Nathan Kaufman, 5212 Cleveland St., Hollywood, Fla. 33021

[22] Filed: Feb. 13, 1976

[21] Appl. No.: 657,899

[52] U.S. Cl. ..... 70/97; 292/108; 292/153; 292/341.19; 292/DIG. 46

[51] Int. Cl.[2] ..... E05B 65/08

[58] Field of Search ..... 292/108, 145, 147, 149, 292/152, 153, 154, 175, 340, 341.18, 341.19, DIG. 46; 70/96, 97, 99; 182/108, 111, 204; 151/35; 248/221 D, 221 F; 52/753 L

[56] References Cited

UNITED STATES PATENTS

| | | | |
|---|---|---|---|
| 315,205 | 4/1885 | Young | 292/153 |
| 565,648 | 8/1896 | Troast | 292/153 X |
| 2,626,456 | 1/1953 | Harrison | 108/55.5 X |
| 2,990,208 | 6/1961 | Miller | 70/97 X |
| 3,173,716 | 3/1965 | Silvers | 292/147 |
| 3,232,664 | 2/1966 | McBride | 248/221 F X |
| 3,269,763 | 8/1966 | Ahlgren | 292/340 X |
| 3,390,557 | 7/1968 | Erickson et al. | 292/152 X |
| 3,856,246 | 12/1974 | Sinko | 248/68 CB |
| 3,904,229 | 9/1975 | Waldo | 292/108 X |

FOREIGN PATENTS OR APPLICATIONS

| | | | |
|---|---|---|---|
| 657,998 | 3/1938 | Germany | 292/340 |
| 559,825 | 5/1956 | Italy | 292/153 |

*Primary Examiner*—Roy D. Frazier
*Assistant Examiner*—William E. Lyddane
*Attorney, Agent, or Firm*—Caesar, Rivise, Bernstein & Cohen, Ltd.

[57] ABSTRACT

A lock for a sliding door is disclosed which comprises an elongated escutcheon having a slidable latching means. The latching means moves between an "open" and a "locked" position. The escutcheon includes means for releasably retaining the latching means in both of the positions. The latching means includes an elongated slot of a first width having at least one enlarged portion of a second width and a locking mechanism having a bolt which extends through the slot and is rotatably secured to the escutcheon. The portions of the bolt extending through the slot have an irregular periphery so that facing in one direction the thickness of the bolt is greater than the width of the portion of the slot of the first width, yet smaller than the portion of the slot of the second width. When the bolt faces in a position rotated a predetermined angular amount from the position facing in the one direction, the thickness of the bolt is less than the width of the slot of the first width. The slot is enlarged at each end thereof so that the latching means can be locked in both an "open" and "locked" position.

6 Claims, 7 Drawing Figures

FIG. 4
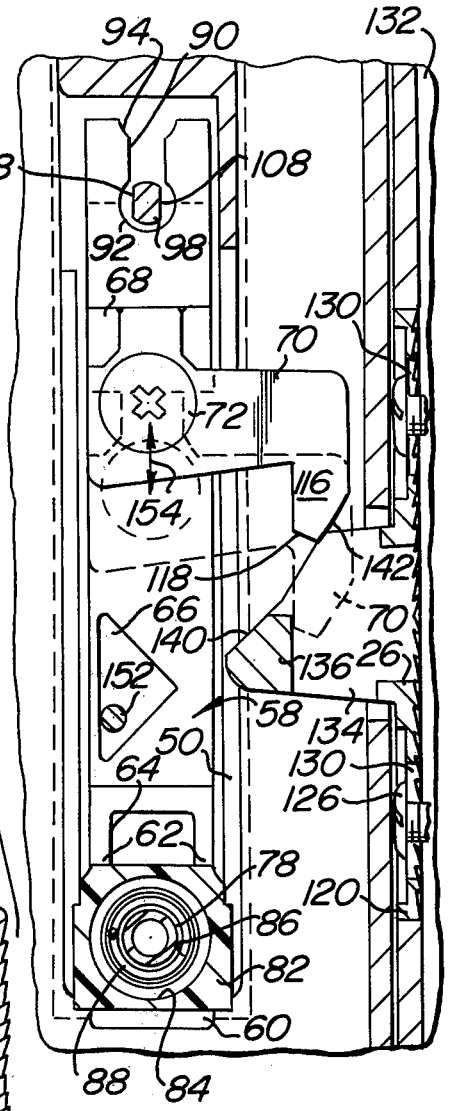
FIG. 2
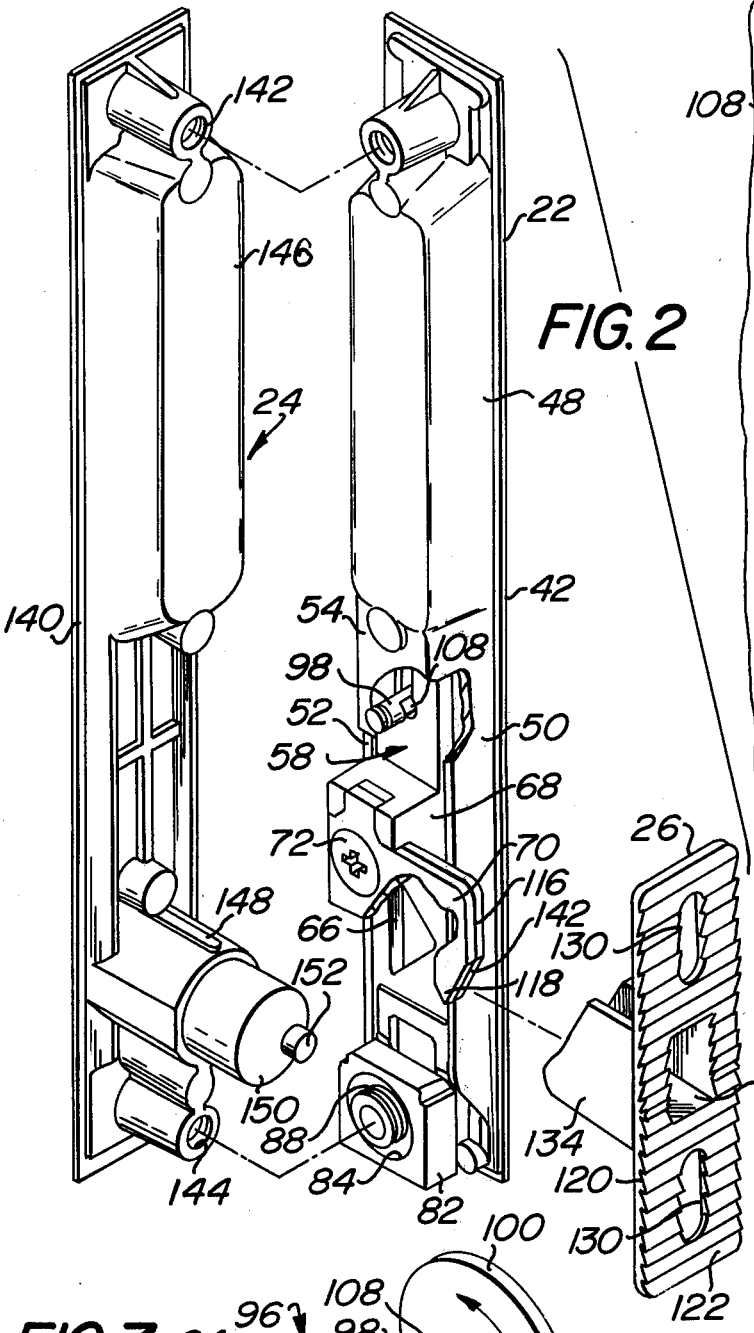
FIG. 7
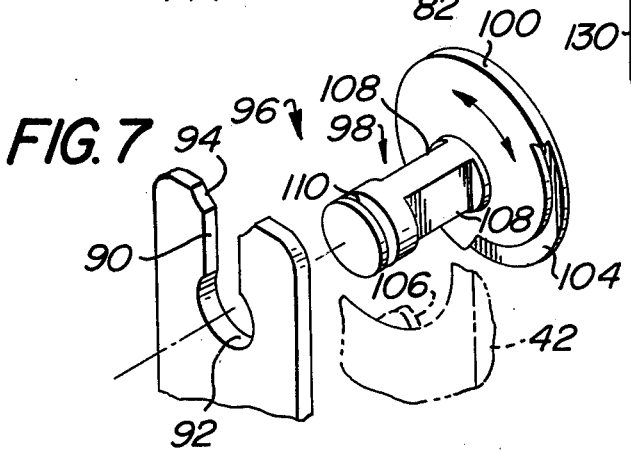
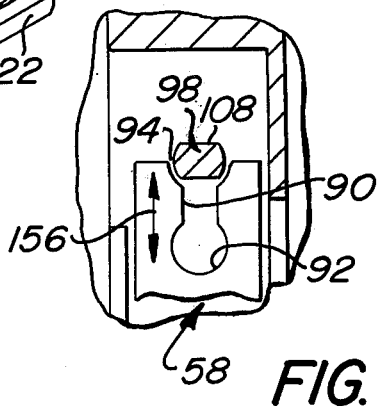
FIG. 5

SLIDING GLASS DOOR LOCK

This invention relates generally to locks and more particularly to a lock for a sliding glass door.

There have been various door latches which have been designed for narrow style sliding glass doors. Among the sliding door locks which have been developed for narrow stile glass doors are the following shown in U.S. patents and Japanese publications and are typical:

| U.S. Pat. No. | PATENTEE | ISSUE DATE |
|---|---|---|
| 3,173,716 | Silvers | March 16, 1965 |
| 3,390,557 | Erickson et al | July 2, 1968 |
| Japanese Publication: | | |
| Publication No. 47-13397 (47[1972].10.17) | | |

In the prior art sliding glass door locks it was typical for the latching means to be slid upwardly to a locking position when the latch was caught in the strike of the opposing stile. However, if there were any problems with the retaining means for holding the latch in the uppermost position, of course, the door could not be locked. Moreover, safety locks which were provided in prior sliding glass door locks to prevent opening from the outside by operation of the locking means on the interior escutcheon were inadequate in view of the fact that typically a latching means was made of a plastic material and did not provide a positive stopping of the sliding latching means. Moreover, the latching means could only be locked in a closed position and thereby enabled an inadvertant locking action to be caused when the door was closed behind someone leaving the house for a short period of time. Another problem with the prior sliding glass door locks is that one end of the latching means was normally free to enable gripping thereof for moving the door latch in an up and down position. However, this free end also enabled lateral movement of the sliding means and caused loosening of the securement at the secured end, as well as gradual deterioration of the securement. Also, a problem from this condition was rattling of the sliding means with respect to the escutcheon.

It is therefore an object of this invention to overcome the disadvantages of the various prior door latches.

Another object of the invention is to provide a new and improved door latch which is of simple construction and which enables the latching means to be in a locked position when the latching means has gripped the strike.

Yet another object of the invention is to provide a new and improved sliding glass door lock which provides an effective safety lock to prevent inadvertant or forced opening from the outside of the lock.

These and other objects of the invention are achieved by providing a new and improved lock for sliding doors which comprises an elongated escutcheon having a slidable latching means for movement between an "open" and "locked" position.

The escutcheon includes means for releasably retaining the latching means in both of the positions. The latching means includes an elongated slot of a first width having at least one enlarged portion of a second width. A locking mechanism is also provided having a bolt which extends through the slot and is rotatably secured to the escutcheon. The portion of the bolt extending through the slot has an irregular shaped periphery so that facing in one direction the thickness of the bolt is greater than the width of the portion of the slot of the first width, yet smaller than the portion of the slot of the second width. When the bolt faces in a position rotated a predetermined angular amount from the position facing in one direction, the thickness of the bolt is less than the width of the slot of the first width.

Other objects and many of the attendant advantages of this invention can be readily appreciated when considered in connection with the accompanying drawing wherein:

FIG. 2 is an exploded interior perspective view of the inside and outside escutcheon and the strike;

FIG. 4 is an enlarged sectional view taken along the line 4—4 in FIG. 3;

FIG. 5 is a fragmentary elevational view of a portion of the locking means as shown in FIG. 4 with the latching means in the locked position;

FIG. 7 is an exploded perspective view of the locking means.

Figure 1:
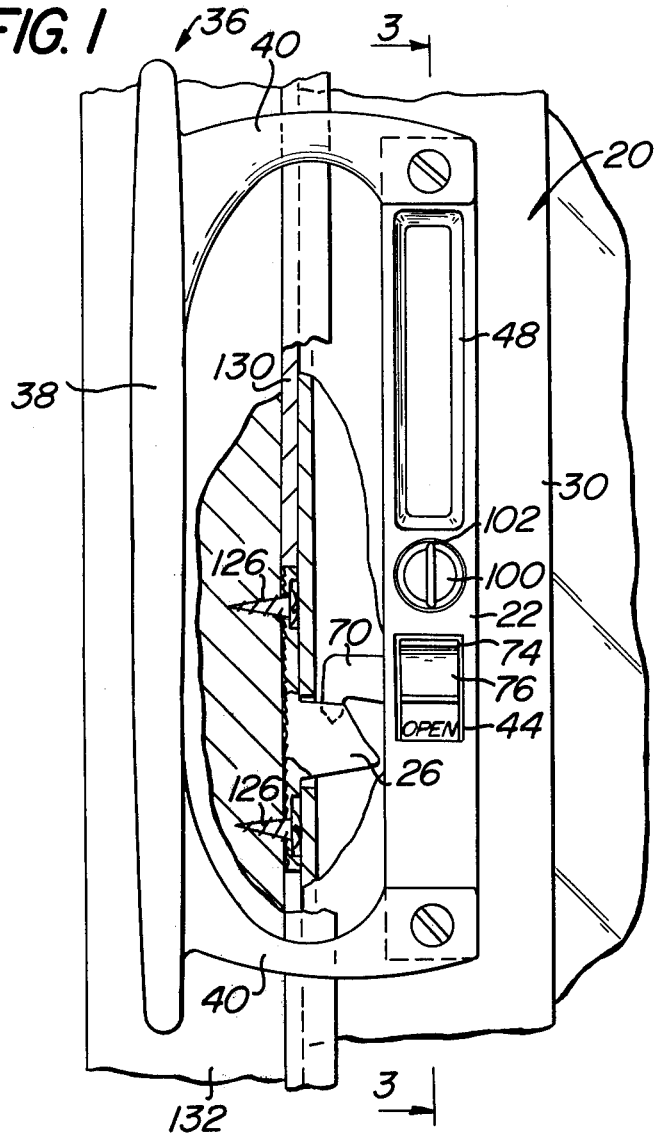
FIG. 1 is a front elevational view of a sliding glass door lock of the invention mounted on the stile of a sliding glass door.
Figure 3:
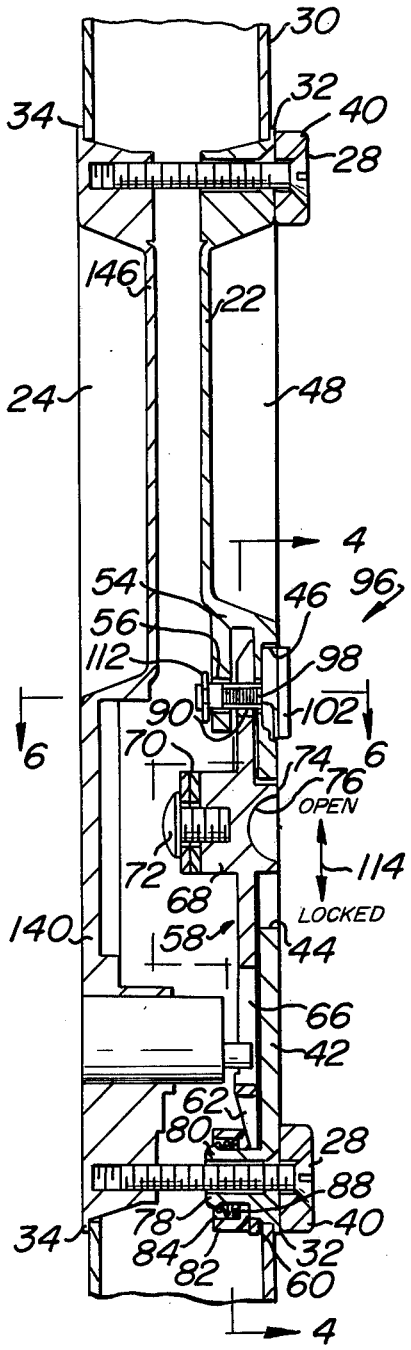
FIG. 3 is an enlarged sectional view taken along the line 3—3 in FIG. 1.

Referring now in greater detail to the various figures of the drawing wherein like reference numerals refer to like parts, a sliding glass door lock embodying the invention is shown generally at 20 in FIG. 1. As best seen in FIGS. 1 and 3, the sliding glass door lock 20 basically comprises an inside escutcheon 22, an outside escutcheon 24 and a strike 26. As best seen in FIG. 3, the inside escutcheon 22 is secured to the outside escutcheon 24 by a pair of threaded fasteners 28 which extend through openings provided at the top and bottom of the inside escutcheon 22 and are threadedly secured in threaded openings provided at the top and bottom of the inside surface of the outside escutcheon 24. The inside escutcheon 22 and the outside escutcheon 24 are disposed in rectangular openings provided in the stile 30 of the sliding glass door. Both the inside and outside escutcheon 22 and 24 include a peripheral flange 32 and 34, respectively, which rests on the inside and outside surfaces of the stile, respectively. The openings in the inside and outside surface of the stile 30 are aligned with respect to each other for receipt of a suitable sliding glass door lock. It should be noted that the openings provided in the stile 30 are conventional openings which are suitable for receipt of prior sliding glass door locks, such as that shown in the Erickson et al U.S. Pat. No. 3,390,557 and in the Japanese Publication No. 47-13397 so that existing stiles need not be modified for receipt of the sliding glass door lock of this invention.

Secured to the outer surface of the inside escutcheon 22 is a handle 36 which includes a grip 38 and a pair of integral legs 40. The legs 40 are secured to the outside surface of the inside escutcheon 22 by the fastener 28 which includes a counter-sunk head which fits snugly into a countersunk opening provided in the legs 40 of the handle 36.

The inside escutcheon 22 is elongated and includes a planar outside wall 42. Wall 42 is substantially rectangular and includes in addition to a pair of openings for fasteners 28, a central rectangular opening 44, a cylindrical opening 46 and an elongated rectangular recessed portion which forms grip or gripping means 48. The recessed grip 48 enables the fingers to be inserted for moving the sliding glass door laterally and supplements the use of the handle 36.

As best seen in FIG. 2, the inside escutcheon 22 includes on the inside wall thereof a channel which extends vertically below the recessed gripping section 48 which is formed by a pair of vertically extending ribs 50 and 52 which are provided on opposite lateral sides of the inside escutcheon 22 and extend transversely to the planar front wall 42. As best seen in FIG. 2, a rectangular plate 54 which extends vertically and parallel to the front wall 42, which is formed integrally with the rear of grip 48 and is transversely connected to and supported by rib 50. As best seen in FIG. 3, the plate 54 includes an opening 56 which is aligned axially with opening 46 of the outside wall 42. The rectangular plate 54 is spaced from the front wall 42 and together forms a box-like construction for constricting the lateral movement of a latching bar 58.

As best seen in FIGS. 3 and 4 the latching bar 58 basically comprises an elongated rectangular bar having a rectangular portion of reduced thickness at 60 at the lowermost end. The reduced thickness portion 60 includes a cam portion 62 which causes a thickening of the section of the bar 58 as it moves upwardly. As will hereinafter be seen, the cam portion acts in combination with resilient retaining means to maintain bar 58 in its uppermost position. Also provided at the lowermost end of the latching bar 58 is a rectangular opening 64 which extends from the thinnest portion 60 up through the main portion of the latching bar 58. Provided above the rectangular opening 64 is a triangular opening 66. As will hereinafter be seen, the triangular opening 66 acts cooperatively with the barrel of a key operated locking means for moving the latching bar in a vertical direction to either latch or unlatch the latching means from the outside of the sliding glass doors. Mounted directly above the triangular openings 66 and formed integrally with the bar 58 is a saddle 68 in which latch 70 is secured and supported by a threaded fastener 72, the latching bar 58 and latch 70 comprise a slidable latching means. On the outside surface of the bar 58 and vertically aligned with the saddle 68 is an outwardly extending rectangular boss 74 in which is provided a semi-cylindrical recess 76. The recess 76 and boss 74 form a finger grip for vertically moving the latching bar 58 in the rear channel of the inside escutcheon.

The boss 74 extends through the rectangular opening 44 of the outside wall 42. Referring to FIG. 3, it can be seen that on the rear surface of the outside wall a cylindrical flange 78 is provided at the bottom of the wall 42, which is integral with an extends transverse to the wall 42 and which includes a cylindrical bore which forms an opening through which the lower fastener 28 extends. The flange 78 includes an enlarged end 80, as best seem in FIG. 3

Telescoped over the cylindrical flange 78 is a thermoplastic rider 82 comprising means for releasably retaining the latch bar 58 and which, as best seen in FIG. 4, is generally rectangular and which includes a cylindrical recess 84 and a cylindrical opening 86 which is co-axial with the recess 84 and extends entirely through the rider 82. As best seen in FIGS. 3 and 4, a coil spring 88 is provided which is provided with an end loop which is smaller than the head 80. The coils are succeedingly larger until the end loop of the coil spring 88, which abuts the innermost surface of the recess 84 of the rider 82. The rider 82 is thus resiliently urged against the inner surface of the latching bar 58 and urges the latching bar 58 against the inner surface of the outside wall 42 of the inside escutcheon. The rider 82, in combination with the spring 88, acts as a resilient retaining means to maintain the latching bar 58 in a fixed vertical position with respect to the inside escutcheon 22. In the position shown in FIG. 3, the rider 82 pressed against the latching bar 58 prevents the latching bar from dropping as a result of gravity. The resilient pressure provided by spring 88 bearing against the rider 82 and then against the inside surface of the bar 58 and further in combination with the abutting action of the topmost corner of the rider 82 against the cam 62 maintains the latching bar 58 in its uppermost position until a manual force provided by inserting a finger in notch 76 overcomes the frictional engagement to move the latching means downwardly. The resilient retaining means also provides a frictional engagement to prevent inadvertant moving upwardly of the latching bar 58.

As best seen in FIG. 4, the latching bar 58 includes, in addition to the openings 64 and 66, a slotted opening 90. The slotted opening 90 includes a central portion which is of a narrow width and, at each end of the slot 90 are portions of enlarged width. That is, at the bottom of slot 90 is a circular opening 92 which is of a larger diameter than the width of the central portion of slot 90. At the upper end of slot 90 is a semi-circular portion 94 which is again of larger diameter than the width of the central portion of slot 90. As best seen in FIG. 3, the uppermost portion of the latching bar 58, which includes the slot 90, is secured within the space between the rectangular plate 54 and the outside wall 42 of the inside escutcheon 22. Thus, the upper end of the latching bar 58 is restrained against lateral movement by the rectangular plate 54 and the wall 42 in a front and back direction with respect to the inside escutcheon plate 22. The top of bar 58 is restrained against left to right movement by a locking member which is referred to generally as 96, as well as ribs 50 and 52.

Figure 6:
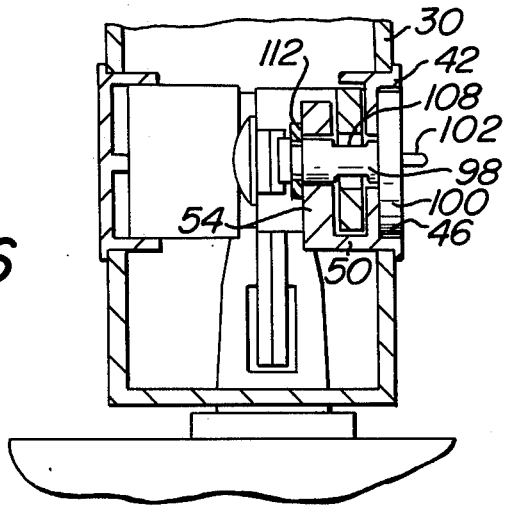
FIG. 6 is a sectional view taken along the line 6—6 in FIG. 3.

Referring to FIG. 7 it can be seen that the locking member 96 basically comprises a lock bolt 98 which is supported by and is integrally secured to a disc 100. The lock bolt 98 extends transversely from the center of the inside surface of disc 100 and is co-axial therewith. Disc 100 includes on its outer surface, as best seen in FIGS. 3 and 6, a finger grip 102. On the inner surface of the disc 100 a peripheral recess 104 is provided, as best seen in FIG. 7. The peripheral recess 104 extends approximately slightly more than 90° which enables the disc to rotate 90°. As best seen in FIG. 6, the disc 100 fits within the enlarged portion or recess of opening 46 in the wall 42. As best seen in FIG. 7 wherein the front wall 42 is shown in phantom, a pin 106 is provided which is mounted in the recess of the enlarged opening, is integral with wall 42 and extends transversely thereto. The pin 106 extends into the peripheral recess 104 of disc 100 and limits the rotatability of the disc 100 to exactly 90°.

As best seen in FIGS. 3 and 7, the lock bolt 98 is cylindrical and includes a pair of recesses 108 on diametrically opposed sides of the cylindrical wall of the bolt 98. In addition, adjacent the end of the bolt 98 is an annular recess 110.

As best seen in FIGS. 3 and 6, the bolt 98 extends through the slotted opening 90 and opening 56 of the plate 54. A spring clip 112 is provided in the annular recess 110 of bolt 98 to secure the lock bolt 98 within the slot 90 of the latching bar 58. As indicated by arrows 114 in FIG. 3, the latching bar 58 is thus capable of sliding up and down in a vertical direction to the "open" and "locked" position at the top and bottom of the vertical extent of its movement, respectively.

As best seen FIG. 4, lock bolt 98 at the portion extending through the slot 90 is an irregular cross-section as a result of the recesses 108. Thus, as seen in FIG. 4, the diameter of bolt 98 is greater facing in the vertical direction than in the horizontal direction.

When the recesses on 108 are provided on the lateral sides of the bolt 98, as shown in FIG. 4, the bolt 98 can pass through the narrower portion of slot 90. However, when the bolt 98 is rotated 90° from the position shown in FIG. 4, to the position shown in FIG. 5, the recesses 108 are on the top and bottom of the bolt 98 and thereby prevents the bolt 98 from passing through the slotted portion 90. It should also be noted at the uppermost extent of the movement of the bar 58, the bolt 98 is in the enlarged portion 92 of the slot 90, as shown in FIG. 4, and can therefore be rotated 90°.

When the bolt 98 is rotated 90° within opening 92 from the position shown in FIG. 4, the latching bar 58 cannot be moved vertically. When the latching bar 58 is moved to its lowermost position, the position of the bar as shown in FIG. 5, the bolt 98 is aligned with the portion 94 of slot 90 and can be rotated 90° to the position shown with the recesses 108 in the top and bottom position of the bolt. Thus, the latching bar is locked in its lowermost position when the bolt 98 is rotated to the position shown in FIG. 5.

As can be seen in phantom in FIG. 4, when the latch 70 is moved to its lowermost position with the latching bar 58, it is engaged in the recess of the strike 26. This prevents the sliding glass door to be moved laterally and thereby maintains the glass door in a closed position.

The latch 70 is best seen in FIGS. 2 and 4. It is comprised of a pair of flat plates which are identical and which together add to the thickness of the latch. The latch 70 includes a downward extending finger 116 which includes a cam surface 118, which extends angularly rearward towards the inside escutcheon and upwardly, and a cam surface 142 which extends angularly upwardly and forwardly.

The strike 26 includes a base plate 120 having a serrated surface 122, which is formed of teeth. The teeth on the portion of plate 120 extend from the center 124 towards the lowermost end of the plate 120, and face in a first direction to prevent movement of the plate 120 downwardly when the plate is secured against a plannar surface. The teeth on the portion of the plate extending upwardly from the center 124 towards the uppermost end of the plate 120, face in the opposite direction to prevent movement upwardly of the plate 120 when the plate is secured against a surface against which the teeth are bearing. Thus, as best seen in FIG. 4, the plate 120 is secured against the lateral wall of a vertically extending door jamb 132 by a pair of fasteners 126 which extend through vertically aligned slotted openings 130 provided in plate 120. Once the plate 120 has been secured against the wall of the jamb 132, the strike cannot be moved upwardly or downwardly since the teeth from the center down prevent the strike from being moved downwardly and the teeth extending upwardly from the center prevent the strike from being moved upwardly.

As best seen in FIGS. 2 and 4, projecting outwardly from plate 120 of the strike is the pair of plates 134 which are bridged by a bridging section 136 which extends transversely to and is integral with the vertical plates 134 at the outermost end thereof. A rectangular opening 138 is provided in plate 120 which extends between the vertical plates 134. As best seen in FIG. 4, the bridging section 136 of the strike includes a cam surface 140 which interacts with cam surface 142 of finger 116 of the latch to move the latch upwardly as the sliding glass door is urged towards the strike with the latch in the lower or "locked" position. The cam surface 118 of the latch acts to ficilitate insertion of the latch in the recess formed between the bridging section 136 and the plate 134 of the strike when the sliding glass doors are closed and the finger 116 is urged into the opening between the bridging section 136 and the plates 134 of the strike.

The outside escutcheon 24 is of conventional construction and basically comprises, as best seen in FIG. 3, an outer plate 140, a pair of threaded openings 142 and 144 for receipt of the top and bottom fasteners 28, an elongated recess 146 which acts as a finger grip to allow manual lateral movement of the sliding glass door from the outside, and a barrel 148 which houses a conventional key operated locking mechanism 150 which has an actuating pin 152.

When the inside escutcheon and the outside escutcheon are assembled together by securement of the threaded fasteners 28 through the openings provided in the inside escutcheon and threadedly engaged in the outside escutcheon, as shown in FIG. 3, the actuating pin 152 of the key operated mechanism 150 is within the triangular opening 66 of the latching bar 58 to enable key operated movement of the latch 70 in the direction of arrows 154 in FIG. 4, as long as the bolt 98 is in the position shown in FIG. 4.

When the bolt 98 is in the position shown in FIG. 5, with the bolt 98 aligned with one of the enlarged portions of the slot 90, latching bar 58 cannot be moved up and down in the direction of arrows 156. Therefore, a safety lock is provided which can prevent key operated opening or closing of the sliding glass door lock when the locking mechanism is in the position shown in FIG. 5.

In operation the sliding glass door lock is best understood with respect to FIG. 1. The sliding glass door is moved into position where the stile 30 abuts the jamb 132. The position of the finger grip 102 of the locking mechanism shown in FIG. 1 has the recesses 108 of the bolt 98 in the position shown in FIG. 4, whereby the latching mechanism can be slid upwardly or downwardly. As indicated by the boss 74 extending through opening 44 of the front plate of the sliding glass door lock, the latching bar is in the upper or "open" position in view of the fact that the boss 74 is adjacent the uppermost extent of opening 44. As indicated in FIG. 1, the positions of the bar are inscribed directly above and below the boss 74 so that below the boss 74 there is preferably inscribed on the front surface of the latching bar 58 the term "open." Directly above the boss 74 (not seen) is inscribed the work "locked." Thus, in the uppermost position of the latching bar 58 and, as shown in FIG. 1, the term "open" appears below the boss 74 and through the opening 44. When a finger is inserted in the semi-circular slot 76 to move the latching means downwardly, the word "locked" will appear above the boss 74 through opening 44.

By moving the latching bar 58 downwardly, latch 78 engages the strike 26 and is engaged in the recess thereof.

By rotating the finger grip 102 of the locking mechanism so that it extends horizontally, the bolt 98 is moved to the position shown in FIG. 5 with respect to the latching bar 58 and thereby locks the sliding glass door with the latching bar in the position shown in FIG. 5. The key operated lock 150 cannot be rotated to move the latching means vertically, since the latching means is stopped by the thickness of bolt 98 which acts as a positive block to movement of the bar 58.

To open the door the finger grip 102 is rotated to its vertical position as shown in FIG. 1, a finger is inserted in slot 76 of boss 74 and the latching bar is lifted upwardly thereby removing the latch 70 from strike 76. The sliding glass door can then be shifted to the right by gripping handle 38 or inserting fingers into grip 48.

It can be seen that the sliding glass door lock of the invention overcomes various problems in the prior art. The strike 26, once it is secured to the surface of the jamb cannot be moved upwardly or downwardly because the teeth of the rear surface of plate 120 lock the plate against vertical movement because of the pair of directions that the teeth extend outwardly from the center.

The locking means provides a positive stopping action to enable locking of the latch against forced and inadvertant opening.

Without further elaboration, the foregoing will so fully illustrate my invention that others may, by applying current or future knowledge, readily adapt the same for use under various conditions of service.

What is claimed as the invention is:

1. A lock for a sliding door comprising a vertically oriented elongated escutcheon having front and rear walls and having a slidable latching means for movement between an "open" and a "locked" position, said escutcheon including means for releasably retaining said latching means in both of said positions, said slideable latching means including a latching bar and a latch secured thereto to lock the sliding door, said latching bar including an elongated slot of a first width having at least one enlarged portion of a second width and a locking mechanism having a bolt which extends through said slot and is rotatably secured to said escutcheon, the portions of said bolt extending through said slot having an irregular periphery so that facing in one direction the thickness of said bolt is greater than the width of said portion of said slot of said first width, and when said bolt faces in a position rotated a predetermined angular amount from said position facing in said one direction, the thickness of said bolt is less than the width of said slot of said first width, said latching bar being disposed in a channel provided in the rear of said escutcheon with said bar being secured at both ends against lateral movement with respect to the escutcheon, said bar being mounted below a gripping means provided in said escutcheon, said gripping means comprising a recess in the upper end of the front wall of said escutcheon, said escutcheon including a rectangular plate in the rear of said escutcheon which is secured to the rearmost wall of said gripping means, said plate being spaced from the front wall of said escutcheon to provide a narrow channel in which said bar extends whereby said bar is restrained against front to rear movement with respect to said escutcheon by said front wall of said escutcheon and said plate at the uppermost end of said bar.

2. The lock of claim 1 wherein said means for releasably retaining said latching means is provided at the lowermost end of said bar to further restrain said bar against front to rear movement with respect to said escutcheon.

3. The lock of claim 1 wherein a strike is provided which is mounted on the door jamb for said sliding door for reception of a latch provided on said latching means, the surface of said strike secured against said jamb having teeth facing in two directions away from the center of said strike to prevent upward or downward movement of said strike after it is secured to said wall.

4. The lock of claim 3 wherein the latch is moved downwardly into the recess for locking said sliding door.

5. The lock of claim 1 wherein said bolt is of circular cross-section with diametrically opposed recesses provided in said bolt.

6. The lock of claim 4 wherein the slot includes a circular portion at the bottom of said slot and a semicircular opening at the top of said slot to provide the portions of larger width.

* * * * *